US009637929B1

(12) United States Patent
Inzeo et al.

(10) Patent No.: US 9,637,929 B1
(45) Date of Patent: May 2, 2017

(54) HIP VENTILATOR

(71) Applicants: Joseph A. Inzeo, West Allis, WI (US); Michael D. Feltz, Waukesha, WI (US); Eric W. Godfrey, Brookfield, WI (US); Marlea R. Knox, Johnson Creek, WI (US); Christopher M. Parent, Mukwonago, WI (US)

(72) Inventors: Joseph A. Inzeo, West Allis, WI (US); Michael D. Feltz, Waukesha, WI (US); Eric W. Godfrey, Brookfield, WI (US); Marlea R. Knox, Johnson Creek, WI (US); Christopher M. Parent, Mukwonago, WI (US)

(73) Assignee: METAL-ERA, INC., Waukesha, WI (US)

( * ) Notice: Subject to any disclaimer, the term of this patent is extended or adjusted under 35 U.S.C. 154(b) by 508 days.

(21) Appl. No.: 14/298,993

(22) Filed: Jun. 9, 2014

Related U.S. Application Data

(60) Provisional application No. 61/842,071, filed on Jul. 2, 2013.

(51) Int. Cl.
*E04D 13/17* (2006.01)
*F24F 7/02* (2006.01)

(52) U.S. Cl.
CPC ..... *E04D 13/174* (2013.01); *F24F 7/02* (2013.01)

(58) Field of Classification Search
CPC ..... E04D 13/174; F24F 7/02
See application file for complete search history.

(56) References Cited

U.S. PATENT DOCUMENTS

| | | | | |
|---|---|---|---|---|
| 2,704,500 | A * | 3/1955 | King | E04D 13/174 454/365 |
| 3,326,113 | A | 6/1967 | Smith et al. | |
| 5,174,076 | A | 12/1992 | Schiedegger et al. | |
| 7,823,343 | B1 * | 11/2010 | Inzeo | E04D 13/1478 454/365 |
| 8,978,323 | B1 * | 3/2015 | Inzeo | E04D 13/174 454/260 |
| 9,297,555 | B2 * | 3/2016 | Daniels | F24J 2/30 |
| 2007/0173191 | A1 * | 7/2007 | Daniels, II | F24F 7/02 454/250 |
| 2008/0299892 | A1 * | 12/2008 | Robinson | E04D 1/30 454/366 |
| 2011/0225907 | A1 * | 9/2011 | Chang | E04D 3/30 52/198 |

(Continued)

*Primary Examiner* — Andrew J Triggs
(74) *Attorney, Agent, or Firm* — Donald J. Ersler

(57) ABSTRACT

A hip ventilator preferably includes a plurality of lower intermittent spacers, a pitched perforated support member, a plurality of upper intermittent spacers, a plurality of hip covers and two hip cover end caps. First and second water dams are attached to a top of the hip roof. The plurality of lower intermittent spacers are then attached to the hip roof over the first and second water dams. The pitched perforated support member is placed on top of the plurality of lower intermittent spacers. The plurality of upper intermittent spacers are attached to the plurality of lower intermittent spacers. The plurality of hip covers are snapped on to the pitched perforated support member. The two hip cover end caps are attached to the roof and two hip covers. A deflector strip is preferably attached adjacent each side of the hip ventilator.

18 Claims, 12 Drawing Sheets

(56) References Cited

U.S. PATENT DOCUMENTS

| | | | | |
|---|---|---|---|---|
| 2011/0294412 | A1* | 12/2011 | Vagedes | F24F 7/02<br>454/242 |
| 2013/0167833 | A1* | 7/2013 | Daniels | F24J 2/30<br>126/621 |

* cited by examiner

HIP VENTILATOR

CROSS-REFERENCES TO RELATED APPLICATIONS

This is a utility patent application taking priority from provisional application No. 61/842,071 filed on Jul. 2, 2013.

BACKGROUND OF THE INVENTION

Field of the Invention

The present invention relates generally to ventilation of buildings and more specifically to a hip ventilator, which is used to ventilate a hip roof.

Discussion of the Prior Art

U.S. Pat. No. 3,326,113 to Smith et al discloses a roof ridge ventilator. U.S. Pat. No. 5,174,076 to Schiedegger et al. discloses a ridge vent for hip roof.

Accordingly, there is a clearly felt need in the art for a hip ventilator, which is used to ventilate a hip roof.

SUMMARY OF THE INVENTION

The present invention provides a hip ventilator, which is used to ventilate a hip roof. The hip ventilator preferably includes a plurality of lower intermittent spacers, a pitched perforated support member, a plurality of upper intermittent spacers, a plurality of hip covers and two hip cover end caps. Each lower intermittent spacer includes a first lower leg portion and a second lower leg portion. The first lower leg portion includes a first bottom flange, a first vertical support and a first top flange. The first bottom flange extends from a bottom of the first vertical support in one direction and the first top flange extends from a top of the first vertical support in an opposite direction. A first water dam clearance slot is formed in the first bottom flange and the first vertical support to provide clearance for a first water dam. The first water dam includes a first attachment flange and a first upright member, which extends from an edge of the first attachment flange.

The second lower leg portion includes a second bottom flange, a second vertical support, a second top flange and a lower attachment tab. The second bottom flange extends from a bottom of the second vertical support in one direction and the second top flange extends from a top of the second vertical support in an opposite direction. The lower attachment tab is preferably formed substantially perpendicular to the second vertical support, but other angles may also be used. A second water dam clearance slot is formed in the second bottom flange and the second vertical support to provide clearance for a second water dam. The second water dam includes a second attachment flange and a second upright member, which extends from an edge of the second attachment flange. The lower attachment tab is attached to the first vertical support, such that the first and second bottom flanges contact a top of the hip roof.

The pitched perforated support member includes a perforated plate. The perforated plate is preferably bent in a middle thereof to match a pitch of a hip roof. A snap flange is formed on opposing sides of the perforated plate, parallel with the bend line. Each upper intermittent spacer includes a first upper leg portion and a second upper leg portion. The first upper leg portion includes a first bottom flange, a first vertical support and a first top flange. The first bottom flange extends from a bottom of the first vertical support in one direction and the first top flange extends from a top of the first vertical support in an opposite direction. The second upper leg portion includes a second bottom flange, a second vertical support, a second top flange and an upper attachment tab. The second bottom flange extends from a bottom of the second vertical support in one direction and the second top flange extends from a top of the second vertical support in an opposite direction. The upper attachment tab is preferably formed substantially perpendicular to the second vertical support, but other angles may also be used. The upper attachment tab is attached to the first vertical support, such that the first and second bottom flanges contact a top of the pitched perforated support member.

Each hip cover includes a sloped peak portion, two side legs and a pair of snap clips. The angle of the sloped peak portion is preferably the same as the pitch of the hip roof. The two side legs extend downward from each side of the sloped peak portion. A bottom of each side leg is terminated with a single snap clip. Each hip cover end cap includes a hip cover, a vertical end member and a pitched flange member. The vertical end member preferably includes a vertical end plate and at least two end tabs. A top and bottom of the vertical end plate is shaped to match a pitch of the hip roof. The at least two end tabs extend perpendicular from a top of the vertical end member. The at least two end tabs are attached into an inside surface of an end of the hip cover with any suitable attachment process. The pitch flange member includes at least two flange tabs that extend upward from an edge thereof. The at least two flange tabs are attached to a bottom of the vertical end plate with any suitable attachment process.

A cover splice includes a splice sloped peak portion, two splice side legs and a pair of splice snap clips. The angle of the splice sloped peak portion is preferably the same as the pitch of the hip roof. The two splice side legs extend downward from each side of the splice sloped peak portion. A bottom of each splice side leg is terminated with a single splice snap clip. The cover splice is snapped over a junction between two hip covers or one hip cover and one hip cover end plate. A deflector system includes a plurality of deflector strips and a plurality of deflector baffles. Each deflector strip includes a deflector flange and an angled deflection member, which extends upward from an edge of the deflector flange. Each deflector baffle includes a deflector baffle flange and an angled deflection baffle member, which extends upward from an edge of the deflector baffle flange.

In use, the first and second water dams are placed on the hip roof. The plurality of lower intermittent spacers are placed over the first and second water dams. The lower intermittent spacers are positioned on the hip roof and the first and second water dams are attached to the hip roof with a plurality of fasteners. The plurality of first and second bottom flanges of the plurality of lower intermittent spacers are attached to a top of the hip roof with a plurality of fasteners. The pitched perforated support member is placed on a top of the plurality of first and second top flanges of the plurality of lower intermittent spaces with a plurality of fasteners. The plurality of first and second bottom flanges of the plurality of upper intermittent spacers are placed on top of the pitched perforated support member. The plurality of first and second bottom flanges of the plurality of upper intermittent spacers are attached to the plurality of top flanges of the plurality of lower intermittent spacers with a plurality of fasteners.

The two hip cover end caps are snapped on to the snap flanges of the pitch perforated support member and the pitched flange member is attached to the hip roof with a plurality of fasteners. The plurality of hip covers are snapped on to the snap flanges of the pitch perforated support member. The cover splice is snapped over the junctions of the hip covers and the hip cover end caps. A single deflector system is preferably installed on each side of the hip ventilator to provide added protection from rain or water.

Accordingly, it is an object of the present invention to provide a hip ventilator, which is used to ventilate a hip roof.

These and additional objects, advantages, features and benefits of the present invention will become apparent from the following specification.

DETAILED DESCRIPTION OF THE PREFERRED EMBODIMENTS

Figure 1:
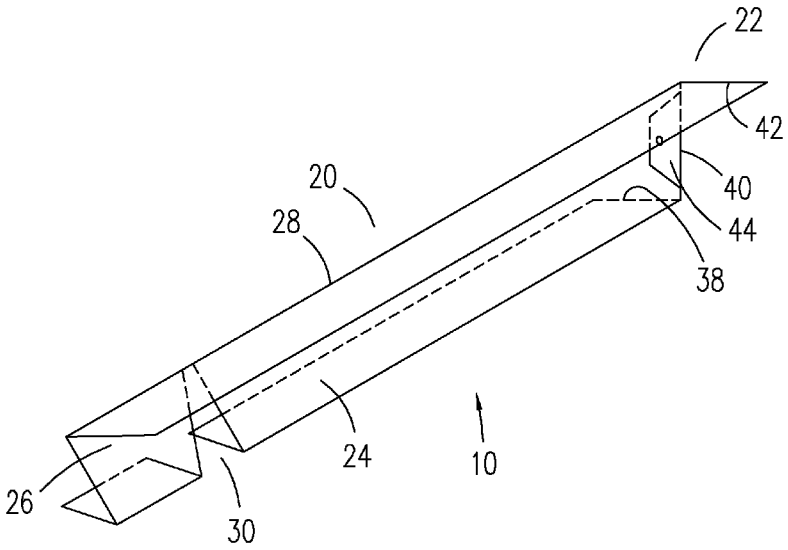
FIG. 1 is a perspective side view of a lower intermittent spacer of a hip ventilator in accordance with the present invention.
Figure 2:
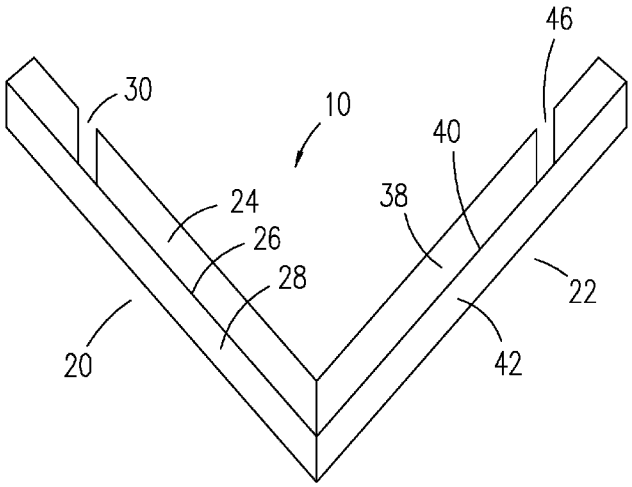
FIG. 2 is a top view of a lower intermittent spacer of a hip ventilator in accordance with the present invention.
Figure 3:
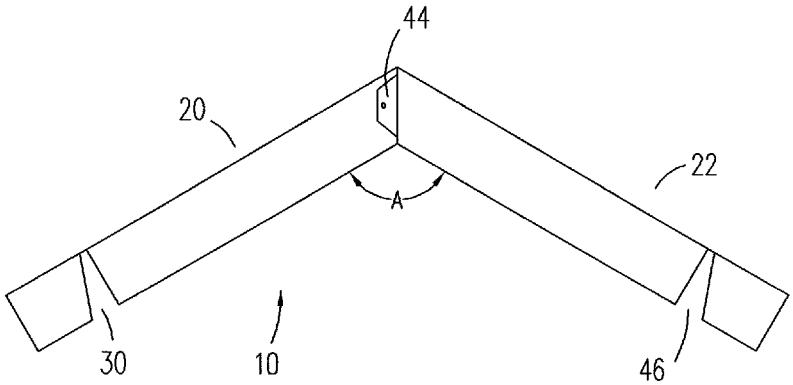
FIG. 3 is a front view of a lower intermittent spacer of a hip ventilator in accordance with the present invention.
Figure 16:
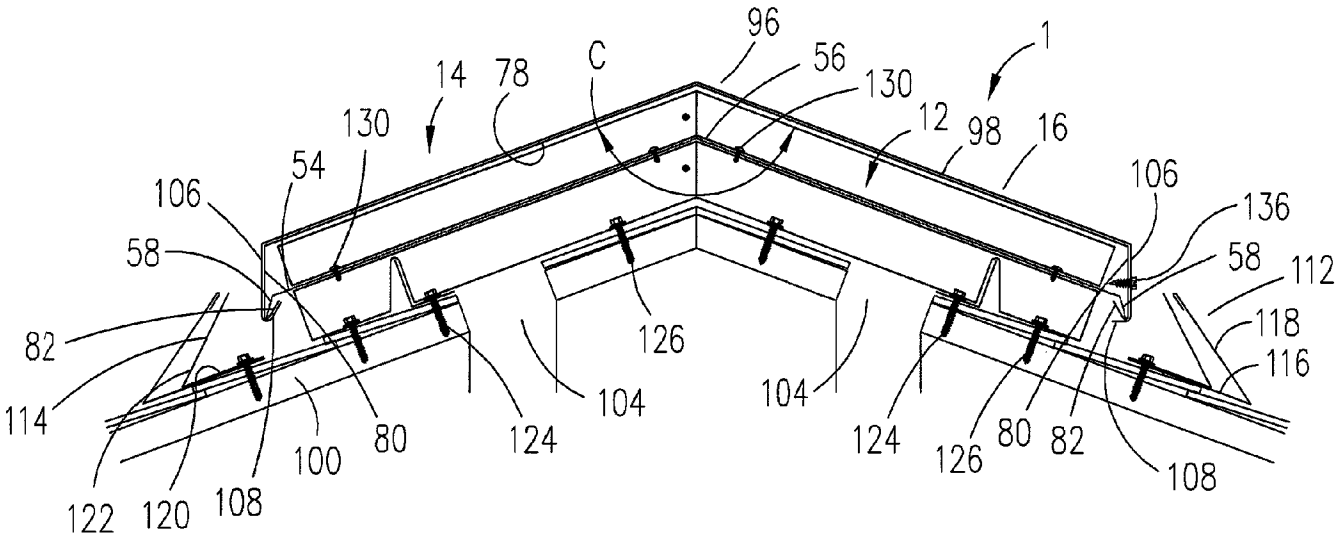
FIG. 16 is an end view of a hip ventilator with a hip cover end cap removed in accordance with the present invention.

With reference now to the drawings, and particularly to FIG. 16, there is shown an end view of a hip ventilator 1. With reference to FIGS. 7-13 and 16, the hip ventilator 1 preferably includes a plurality of lower intermittent spacers 10, a pitched perforated support member 12, a plurality of upper intermittent spacers 14, a plurality of hip covers 16 and two hip cover end caps 18. With reference to FIGS. 1-3, each lower intermittent spacer 10 includes a first lower leg portion 20 and a second lower leg portion 22. The first lower leg portion 20 includes a first bottom flange 24, a first vertical support 26 and a first top flange 28. The first bottom flange 24 extends from a bottom of the first vertical support 26 in one direction and the first top flange 28 extends from a top of the first vertical support 24 in an opposite direction. A first water dam clearance slot 30 is formed in the first bottom flange 24 and the first vertical support 26 to provide clearance for a first water dam 32. The first water dam 32 includes a first attachment flange 34 and a first upright member 36, which extends from an edge of the first attachment flange 34.

The second lower leg portion 22 includes a second bottom flange 38, a second vertical support 40, a second top flange 42 and a lower attachment tab 44. The second bottom flange 38 extends from a bottom of the second vertical support 40 in one direction and the second top flange 42 extends from a top of the second vertical support 40 in an opposite direction. The lower attachment tab 44 is preferably formed substantially perpendicular to an end of the second vertical support 40. A second water dam clearance slot 46 is formed in the second bottom flange 38 and the second vertical support 40 to provide clearance for a second water dam 48. The second water dam 48 includes a second attachment flange 50 and a second upright member 52, which extends from an edge of the second attachment flange 50. The lower attachment tab 44 is attached to the first vertical support 26, such that the first and second bottom flanges contact a top of a hip roof 100 and have an angle "A" relative to each other. At least one ventilation opening 104 is formed through the hip roof 100.

Figure 4:
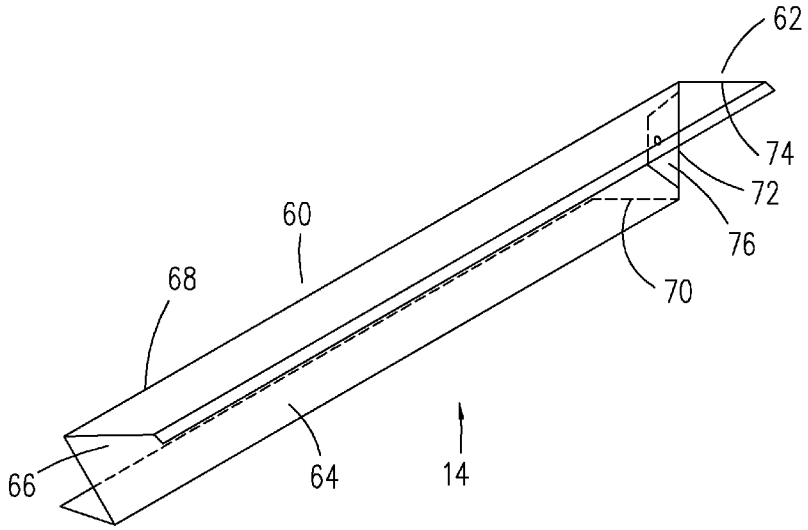
FIG. 4 is a perspective side view of an upper intermittent spacer of a hip ventilator in accordance with the present invention.
Figure 5:
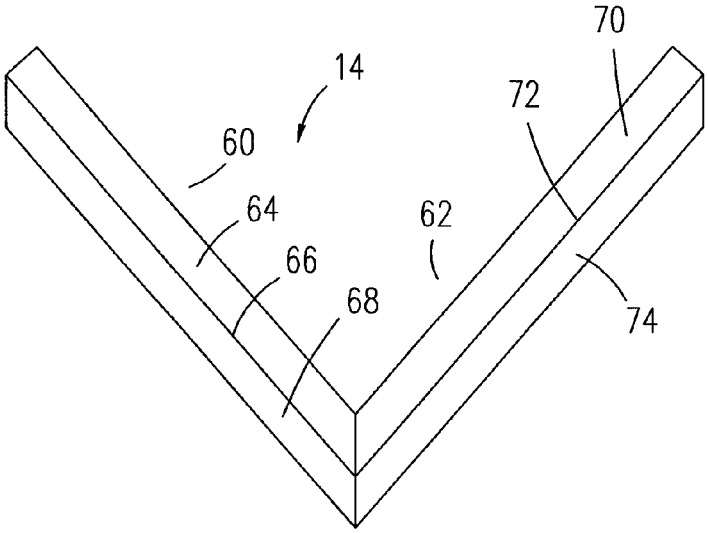
FIG. 5 is a top view of an upper intermittent spacer of a hip ventilator in accordance with the present invention.
Figure 6:
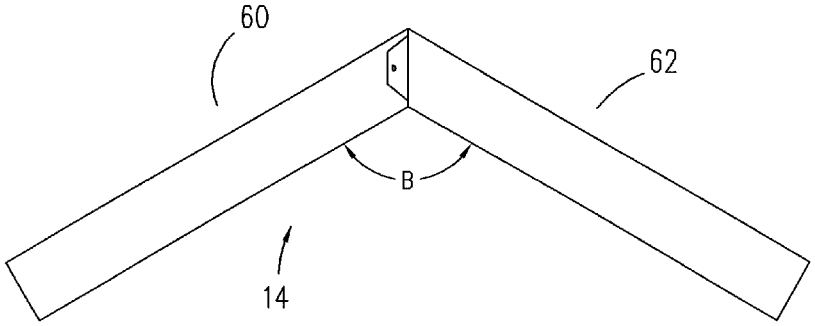
FIG. 6 is a front view of an upper intermittent spacer of a hip ventilator in accordance with the present invention.
Figure 7:
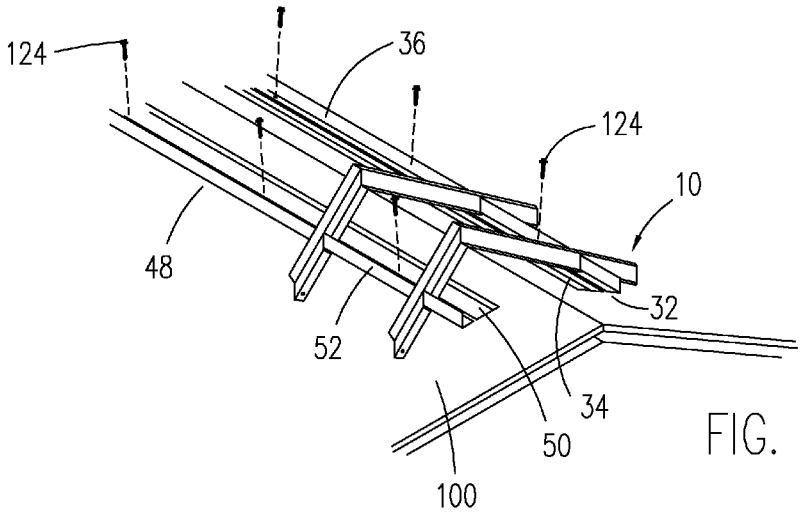
FIG. 7 is a perspective view of first and second water dams being attached to a hip roof and a plurality of lower intermittent spacers positioned over the first and second water dams of a hip ventilator in accordance with the present invention.
Figure 8:
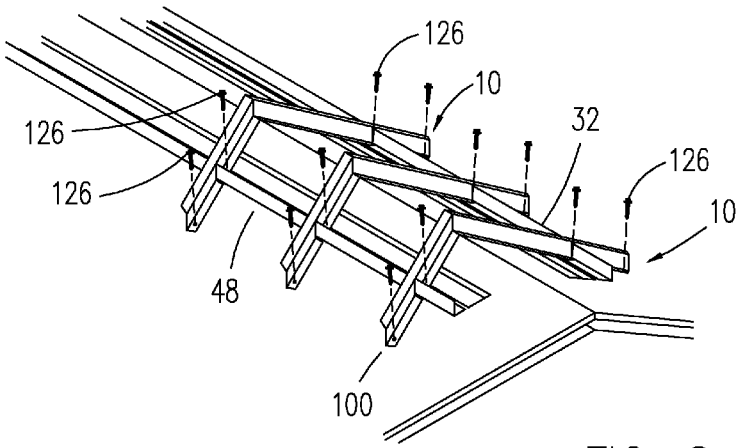
FIG. 8 is a perspective view of a plurality of lower intermittent spacers being attached to a hip roof of a hip ventilator in accordance with the present invention.
Figure 9:
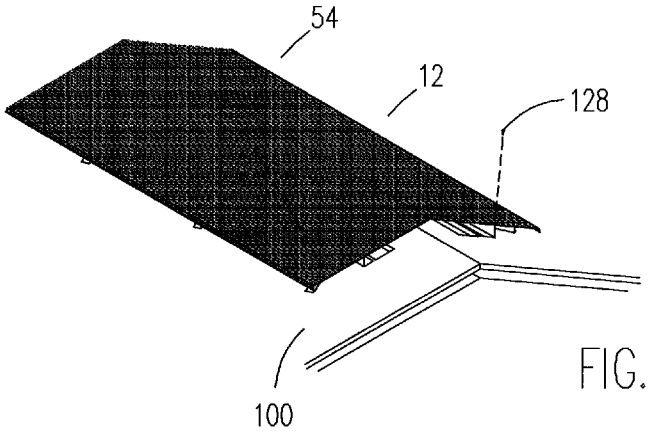
FIG. 9 is a perspective view of a pitched perforated support member being temporarily attached to a plurality of lower intermittent spacers of a hip ventilator in accordance with the present invention.
Figure 10:
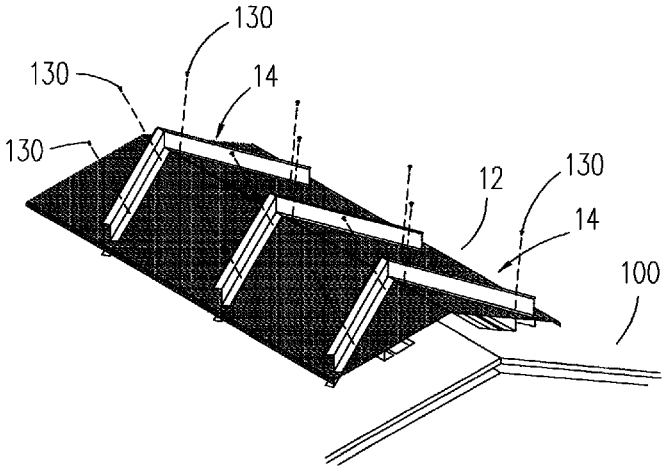
FIG. 10 is a perspective view of a plurality of upper intermittent spacers being attached to a plurality of lower intermittent spaces of a hip ventilator in accordance with the present invention.

With reference to FIG. 16, the pitched perforated support member 12 includes a perforated plate 54. The perforated plate 54 is bent along a bend line 56 in a middle thereof to form to match a pitch of the hip roof 100. A snap flange 58 is formed on opposing sides of the perforated plate 54, parallel with the bend line 56. With reference to FIGS. 4-6, each upper intermittent spacer 14 includes a first upper leg portion 60 and a second upper leg portion 62. The first upper leg portion 60 includes a first bottom flange 64, a first vertical support 66 and a first top flange 68. The first bottom flange 64 extends from a bottom of the first vertical support 66 in one direction and the first top flange 68 extends from a top of the first vertical support 66 in an opposite direction. The second upper leg portion 62 includes a second bottom flange 70, a second vertical support 72, a second top flange 74 and an upper attachment tab 76. The second bottom flange 70 extends from a bottom of the second vertical support 72 in one direction and the second top flange 74 extends from a top of the second vertical support 72 in an opposite direction. The upper attachment tab 76 is preferably formed substantially perpendicular to an end of the second vertical support 72, but other angles may also be used. The upper attachment tab 76 is attached to the second vertical support 66, such that the first and second bottom flanges contact a top of the pitched perforated support member and have an angle "B" relative to each other.

Figure 11:
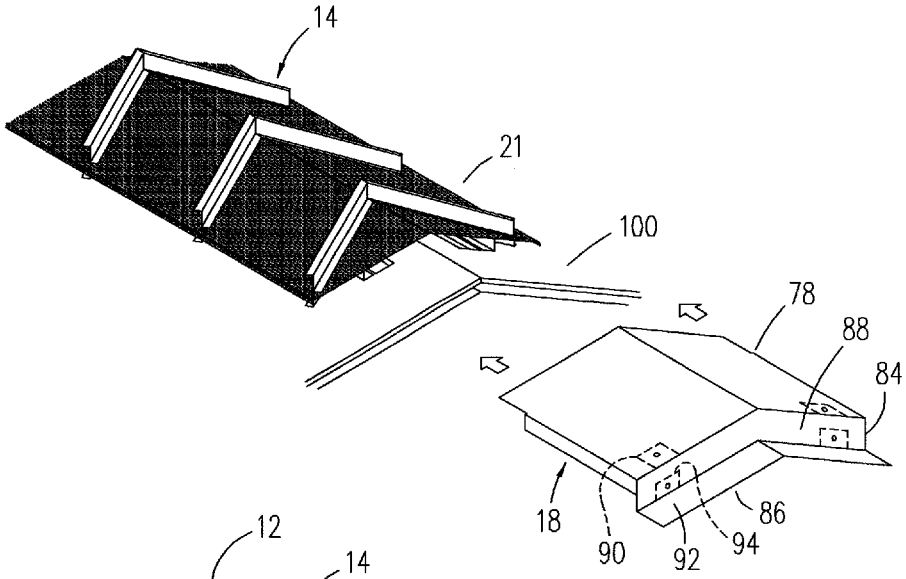
FIG. 11 is a partially exploded perspective view of a hip cover end cap, a plurality of lower intermittent spacers, a pitched perforated support member and a plurality of upper intermittent spacers of a hip ventilator in accordance with the present invention.
Figure 12:
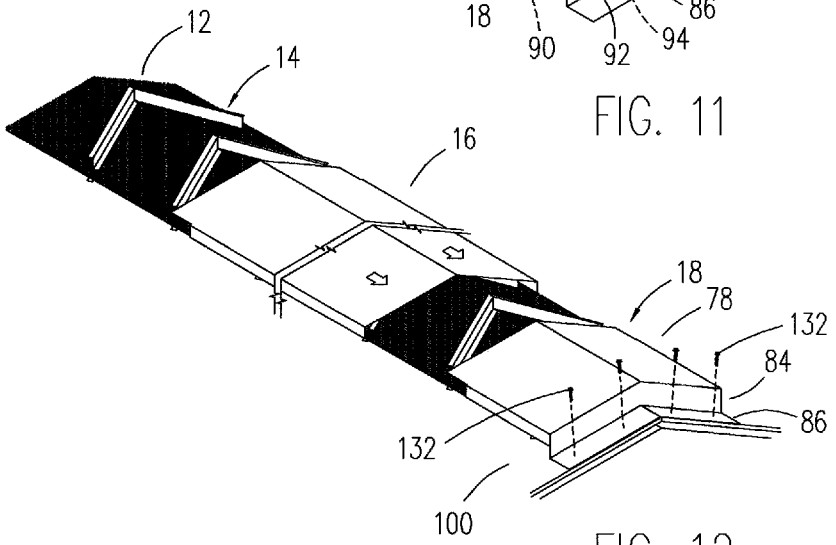
FIG. 12 is a perspective view of a hip cover end cap being attached to a hip roof and a plurality of hip covers retained on a pitched perforated support member of a hip ventilator in accordance with the present invention.

With reference to FIGS. 11, 12 and 16, each hip cover 16 includes a sloped peak portion 78, two side legs 80 and a pair of snap clips 82. An angle "C" of the sloped peak portion 78 is preferably the same as the pitch of the hip roof 100. The two side legs 80 extend downward from each side of the sloped peak portion 78. A bottom of each side leg 80 is terminated with a single snap clip 82. Each hip cover end cap 18 includes a hip cover 78, a vertical end member 84 and a pitched flange member 86. The vertical end member 84 preferably includes a vertical end plate 88 and at least two end tabs 90. A top and bottom of the vertical end plate 88 is shaped to match a pitch of the hip roof 100. The at least two end tabs extend perpendicular from a top of the vertical end member 88. The at least two end tabs 90 are attached into an inside surface of an end of the hip cover 78 with any suitable attachment process. The pitch flange member 86 includes a pitch flange member 92 and at least two flange tabs 94 that extend upward from an edge thereof. The at least two flange tabs 94 are attached to a bottom of the vertical end plate 88 with any suitable attachment process.

Figure 13:
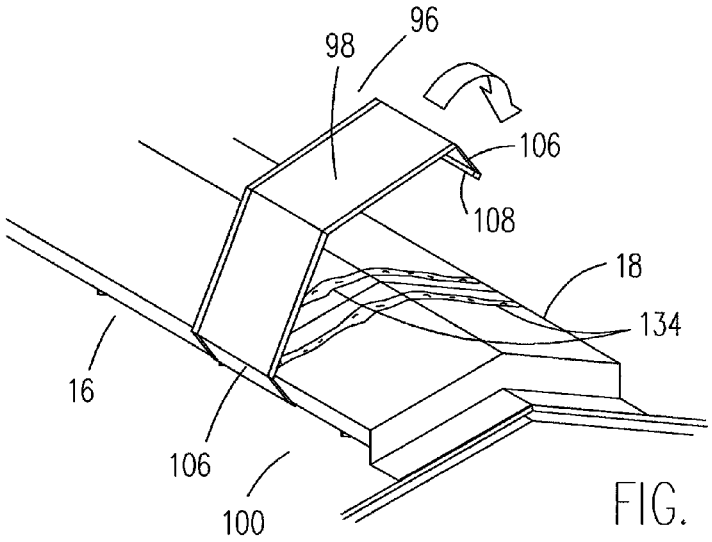
FIG. 13 is a perspective view of a cover splice being attached to a hip cover and a hip cover end cap of a hip ventilator in accordance with the present invention.
Figure 14:
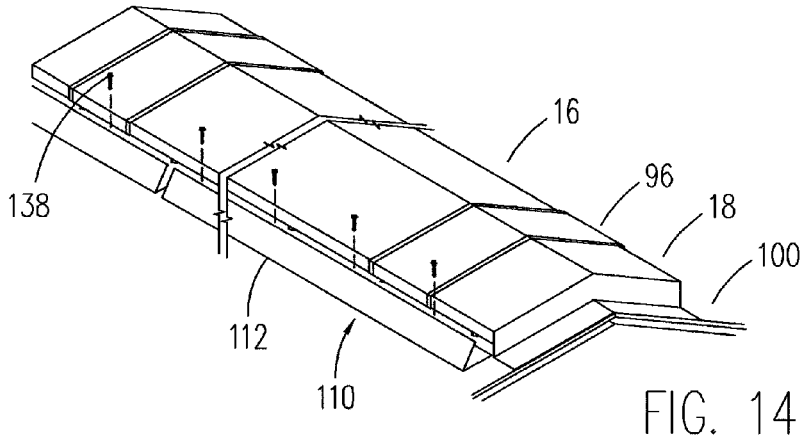
FIG. 14 is a perspective view of a deflector strip of a deflector system being attached to a hip roof of a hip ventilator in accordance with the present invention.
Figure 15:
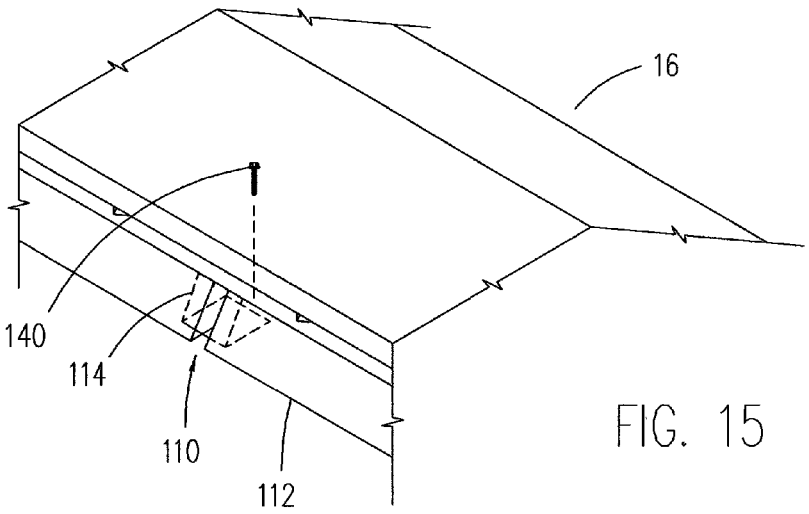
FIG. 15 is a perspective view of a deflector baffle of a deflector system being attached to a hip roof of a hip ventilator in accordance with the present invention.

With reference to FIG. 13, a cover splice 96 includes a splice sloped peak portion 98, two splice side legs 106 and a pair of splice snap clips 108. The angle of the splice sloped peak portion 98 is preferably the same as the pitch of the hip cover 16. The two splice side legs 106 extend downward from each side of the splice sloped peak portion 98. A bottom of each splice side leg is terminated with a single splice snap clip 108. The cover splice 96 is snapped over a junction between two hip covers 16 or one hip cover 16 and one hip cover end plate 18. With reference to FIGS. 14-15, A single deflector system 110 is preferably installed on each side of the hip ventilator 1 to provide added protection from rain or water. The deflector system 110 includes a plurality of deflector strips 112 and a plurality of deflector baffles 114. Each deflector strip 112 includes a deflector flange 116 and an angled deflection member 118, which extends upward from an edge of the deflector flange 116. Each deflector baffle 114 includes a deflector baffle flange 120 and an angled deflection baffle member 122, which extends upward from an edge of the deflector baffle flange 120.

In use, the first and second water dams 32, 48 are placed on the hip roof 100. The plurality of lower intermittent spacers 10 are placed over the first and second water dams 32, 48. The lower intermittent spacers 10 positioned on the hip roof 100 and the first and second water dams 32, 48 are attached to the hip roof 100 with a plurality of fasteners 124. The plurality of first and second bottom flanges 24, 38 of the plurality of lower intermittent spacers 10 are attached to a top of the hip roof 100 with a plurality of fasteners 126. The pitched perforated support member 12 is placed on a top of the plurality of first and second top flanges 28, 42 of the plurality of lower intermittent spaces 10. The pitched perforated support member 12 may be temporarily retained in position with at least two fasteners 128.

The plurality of first and second bottom flanges 68, 74 of the plurality of upper intermittent spacers 14 are placed on top of the pitched perforated support member 12. The plurality of first and second bottom flanges 64, 70 of the plurality of upper intermittent spacers 14 are attached to the plurality of top flanges 28, 42 of the plurality of lower intermittent spacers 10 with a plurality of fasteners 130. The two hip cover end caps 18 are snapped on to the snap flanges 58 of the pitch perforated support member 12 and the pitched flange member 86 is attached to the hip roof 100 with a plurality of fasteners 132. The plurality of hip covers 16 are snapped on to the snap flanges 58 of the pitch perforated support member 12. A sealant 134 is preferably applied to the ends of the hip covers 16 before attachment of the cover splice 96. The cover splice 96 is snapped over the junctions of the hip covers 16 and the hip cover end caps 18. The plurality of hip covers 16 may be secured to the plurality of cover splices 96 with a plurality of fasteners 136.

The plurality deflector strips 112 are spaced apart from each other adjacent each side of the hip ventilator 1. The deflector flanges 116 of the plurality deflector strips 112 are attached to the hip roof 100 with a plurality of fasteners 138. The plurality of deflector baffles 114 are positioned behind the plurality of gaps between the plurality of deflector strips 112. The deflector baffle flanges 120 of the plurality deflector baffles 114 are attached to the hip roof 100 with a plurality of fasteners 140.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A hip ventilator comprising:

a first water dam and a second water dam are attached to a hip roof;

a plurality of lower intermittent spacers, at least one of said plurality of lower intermittent spacers includes a first lower leg portion and a second lower leg portion, one end of said first lower leg portion is retained on one end of said second lower leg portion, said first and second water dams are retained under said plurality of lower intermittent spacers;

a pitched perforated support member is placed on top of said plurality of lower intermittent spacers, said pitched perforated support member includes a perforated plate, a bend is formed in a middle of said perforated plate to match a pitch of the hip roof;

a plurality of upper intermittent spacers, at least one of said plurality of upper intermittent spacers includes a first upper leg portion and a second upper leg portion, one end of said first upper leg portion is retained on one end of said second upper leg portion, said plurality of upper intermittent spacers are attached to said plurality of lower intermittent spacers; and a plurality of hip covers are attached to said pitched perforated support member.

2. The hip ventilator of claim 1 wherein:

said first lower leg portion includes a first bottom flange, a first vertical support and a first top flange, said second lower leg portion includes a second bottom flange, a second vertical support and a second top flange and a lower attachment tab, said lower attachment tab is secured to said one end of said first lower leg portion.

3. The hip ventilator of claim 1 wherein:

said first lower leg portion includes a first water dam slot to provide clearance for said first water dam, said second lower leg portion includes a second water dam slot to provide clearance for said second water dam.

4. The hip ventilator of claim 1 wherein:

said first upper leg portion includes a first bottom flange, a first vertical support and a first top flange, said second upper leg portion includes a second bottom flange, a second vertical support and a second top flange and an upper attachment tab, said upper attachment tab is secured to said one end of said first upper leg portion.

5. The hip ventilator of claim 1 wherein:

said hip cover includes a sloped peak portion, two side legs and a pair of snap clips, said two side legs extend downward from each side of said sloped peak portion.

6. The hip ventilator of claim 1, further comprising:

a deflector system includes a plurality of deflector strips and a plurality of deflector baffles, said deflector system is positioned on each side of said hip ventilator.

7. A hip ventilator comprising:

a first water dam and a second water dam are attached to a hip roof;

a plurality of lower intermittent spacers, at least one of said plurality of lower intermittent spacers includes a first lower leg portion and a second lower leg portion, one end of said first lower leg portion is retained on one end of said second lower leg portion, said first and second water dams are retained under said plurality of lower intermittent spacers;

a pitched perforated support member is placed on top of said plurality of lower intermittent spacers, said pitched perforated support member includes a perforated plate, a bend is formed in a middle of said perforated plate to match a pitch of the hip roof, a snap flange is formed on opposing sides of said perforated support member;

a plurality of upper intermittent spacers, at least one of said plurality of upper intermittent spacers includes a first upper leg portion and a second upper leg portion, one end of said first upper leg portion is retained on one end of said second upper leg portion, said plurality of upper intermittent spacers are attached to said plurality of lower intermittent spacers; and a plurality of hip covers are attached to said pitched perforated support member.

8. The hip ventilator of claim 7 wherein:

said first lower leg portion includes a first bottom flange, a first vertical support and a first top flange, said second lower leg portion includes a second bottom flange, a second vertical support and a second top flange and a lower attachment tab, said lower attachment tab is secured to said one end of said first lower leg portion.

9. The hip ventilator of claim 7 wherein:

said first lower leg portion includes a first water dam slot to provide clearance for said first water dam, said second lower leg portion includes a second water dam slot to provide clearance for said second water dam.

10. The hip ventilator of claim 7 wherein:

said first upper leg portion includes a first bottom flange, a first vertical support and a first top flange, said second upper leg portion includes a second bottom flange, a second vertical support and a second top flange and an upper attachment tab, said upper attachment tab is secured to said one end of said first upper leg portion.

11. The hip ventilator of claim 7 wherein:

said hip cover includes a sloped peak portion, two side legs and a pair of snap clips, said two side legs extend downward from each side of said sloped peak portion.

12. The hip ventilator of claim 7, further comprising:

a deflector system includes a plurality of deflector strips and a plurality of deflector baffles, said deflector system is positioned on each side of said hip ventilator.

13. A hip ventilator comprising:

a first water dam and a second water dam are attached to a hip roof;

a plurality of lower intermittent spacers, at least one of said plurality of lower intermittent spacers includes a first lower leg portion and a second lower leg portion, one end of said first lower leg portion is retained on one end of said second lower leg portion, said first and second water dams are retained under said plurality of lower intermittent spacers;

a pitched perforated support member is placed on top of said plurality of lower intermittent spacers, said pitched perforated support member includes a perforated plate, a bend is formed in a middle of said perforated plate to match a pitch of the hip roof;

a plurality of upper intermittent spacers, at least one of said plurality of upper intermittent spacers includes a first upper leg portion and a second upper leg portion, one end of said first upper leg portion is retained on one end of said second upper leg portion, said plurality of upper intermittent spacers are attached to said plurality of lower intermittent spacers;

a plurality of hip covers are attached to said pitched perforated support member; and said hip ventilator includes opposing ends, each one of said opposing ends of said hip ventilator is terminated with a hip cover end cap.

14. The hip ventilator of claim 13 wherein:

said first lower leg portion includes a first bottom flange, a first vertical support and a first top flange, said second lower leg portion includes a second bottom flange, a second vertical support and a second top flange and a lower attachment tab, said lower attachment tab is secured to said one end of said first lower leg portion.

15. The hip ventilator of claim 13 wherein:

said first lower leg portion includes a first water dam slot to provide clearance for said first water dam, said second lower leg portion includes a second water dam slot to provide clearance for said second water dam.

16. The hip ventilator of claim 13 wherein:

said first upper leg portion includes a first bottom flange, a first vertical support and a first top flange, said second upper leg portion includes a second bottom flange, a second vertical support and a second top flange and an upper attachment tab, said upper attachment tab is secured to said one end of said first upper leg portion.

17. The hip ventilator of claim 13 wherein:

said hip cover includes a sloped peak portion, two side legs and a pair of snap clips, said two side legs extend downward from each side of said sloped peak portion.

18. The hip ventilator of claim 13, further comprising:

a deflector system includes a plurality of deflector strips and a plurality of deflector baffles, said deflector system is positioned on each side of said hip ventilator.

* * * * *